US005561834A

United States Patent [19]

Score

[11] Patent Number: 5,561,834

[45] Date of Patent: Oct. 1, 1996

[54] PNEUMATIC ISOSTATIC COMPACTION OF SINTERED COMPACTS

[75] Inventor: David A. Score, Shirley, Ind.

[73] Assignee: General Motors Corporation, Detroit, Mich.

[21] Appl. No.: 434,348

[22] Filed: May 2, 1995

[51] Int. Cl.[6] ..... B22F 1/02

[52] U.S. Cl. ..... 419/19; 419/38; 419/44; 419/66

[58] Field of Search ..... 419/19, 38, 44, 419/66

[56] References Cited

U.S. PATENT DOCUMENTS

| | | | |
|---|---|---|---|
| 2,878,140 | 3/1959 | Barr | 117/65 |
| 3,279,917 | 10/1966 | Ballard et al. | 75/226 |
| 3,284,195 | 11/1966 | Googin et al. | 75/226 |
| 3,363,037 | 1/1968 | Levey, Jr. et al. | 264/125 |
| 3,419,935 | 1/1969 | Pfeiler et al. | 18/5 |
| 3,562,371 | 2/1971 | Bush | 264/65 |
| 3,571,850 | 3/1971 | Pohto et al. | 18/5 |
| 3,577,635 | 5/1971 | Bergman et al. | 29/615 |
| 4,359,336 | 11/1982 | Bowles | 75/226 |
| 4,431,605 | 2/1984 | Lueth | 419/26 |
| 4,539,175 | 9/1985 | Lichti et al. | 419/49 |
| 4,564,501 | 1/1986 | Goldstein | 419/25 |
| 4,582,681 | 4/1986 | Asari et al. | 419/49 |
| 4,699,763 | 10/1987 | Sinharoy et al. | 419/11 |
| 4,722,825 | 2/1988 | Goldstein | 419/8 |
| 4,744,943 | 5/1988 | Timm | 419/10 |
| 4,810,289 | 3/1989 | Hoyer et al. | 75/232 |
| 4,856,311 | 8/1989 | Conaway | 72/56 |
| 4,921,666 | 5/1990 | Ishii | 419/25 |
| 4,942,750 | 7/1990 | Conaway | 75/56 |
| 5,110,542 | 5/1992 | Conaway | 419/25 |

FOREIGN PATENT DOCUMENTS

| | | | |
|---|---|---|---|
| 680160 | 2/1964 | Canada | 29/189 |

OTHER PUBLICATIONS

H. S. Navar et al, "Nitracolor Process to Improve Corrosion Resistance of Sintered Steel Parts", Airco Industrial Gases, Murray Hill, NJ 07974—Date Unknown.

R. F. Tavenner et al, "Hot Isostatic Forging of Materials at Pressures up to 60,000 PSI", MRS Proceedings, vol 251, Jan. 1992—Paper presented Dec. 1991 MRS Meeting in Boston.

J. M. Capus et al, "Secondary Operations, Quality, and Standards", Advances in Powder Metallurgy & Particulate Materials—1992, vol. 4.

*Primary Examiner*—Charles T. Jordan
*Assistant Examiner*—Daniel Jenkins
*Attorney, Agent, or Firm*—Lawrence B. Plant

[57] ABSTRACT

A process for pneumatically isostatically compacting a sintered compact to densify the compact wherein the surface of the compact is oxidized to form a gas impervious oxide barrier on said surface before the compact is subjected to the pneumatic isostatic compaction process. Oxidation of the compact surface is preferably accomplished by steaming the compact before or after sintering.

7 Claims, No Drawings

PNEUMATIC ISOSTATIC COMPACTION OF SINTERED COMPACTS

This invention relates to the pneumatic isostatic compaction of sintered iron compacts, and more particularly to the pretreatment of such compacts to simplify, and improve the economics of, isostatic compaction processes therefor.

BACKGROUND OF THE INVENTION

It is well known to make sintered products by compacting a plurality of iron particles in a die to form an unsintered, so-called "green", compact, and then heating the green compact in a protective atmosphere at a suitable temperature for a time sufficient to effect solid state bonding (i.e., sintering) of the particles to each other. Compaction may be uniaxial or isostatic. In uniaxial compaction, the particles are placed in a die and pressed in one direction by a punch. In isostatic compaction, the particles are placed in a flexible mold/container (e.g., rubber bag, sheet metal can, etc.), submerged in a pressurized fluid (i.e., gas or liquid) pressing medium, and pressed in all directions either at ambient or at elevated temperatures. One such isostatic compaction process using a liquid pressing medium is known as the HIP, which stands for "Hot Isostatic Pressing". Another such isostatic process using a gas pressing medium is known as the PIF process, which stands for "Pneumatic Isostatic Forging".

Known variations of the aforesaid sintering process include such additional steps as: (a) mixing lubricants with the particles, and heating the particles (e.g., 1400° F.–1600° F.) to drive off the lubricants (i.e., "delubing") between the compaction and sintering steps; (b) repressing and resintering the sintered compact following initial sintering; and (c) isostatically compacting the sintered compact to further densify it. The PIF process has been used to so densify sintered compacts. To densify a sintered compact using the PIF process, the as-sintered compact has heretofore been: (a) cooled down to ambient temperature; (b) encased in a shell which seals its outer surface against penetration of the gaseous pressing medium into the bowels of the sintered compact; (c) heated back up to the sintering temperature; and then (d) surrounded by, and subjected to, pressing gas pressures sufficiently high (i.e., ca. 10,000 psi to ca. 60,000 psi) as to densify the sintered compact. The sealing shell may take several forms including, (1) packaging the compact in an evacuated thin flexible sheet metal can/mold, (2) applying a sealant (e.g., molten glass or electroless nickel) to the surface of the compact to seal the surface pores, and (3) shot peening the surface of the sintered compact to mechanically close the pores at the surface.

Isostatic compacting processes are very costly due to long cycle times including cooling and reheating steps, high labor and energy content, and the need to package, or seal the surface of, the compact. The technique of the present invention is a cost effective improvement to the PIF process which utilizes an oxide sealant grown in situ on the surface of the compact at an elevated temperature in lieu of packaging, or otherwise sealing the surface of the compact. The technique contemplates a continuous process wherein the compact moves on a belt through an elongated furnace having different regions/chambers for sequentially effecting the different operations while eliminating unnecessary cooling and handling of the compact midway in the process, and eliminating the need for costly sealing materials and the labor to apply them.

SUMMARY OF THE INVENTION

The present invention contemplates an improved pneumatic isostatic compacting method for densifying a sintered iron compact including the principle step of sealing the outside surface of the compact with a substantially gas impervious layer of iron oxide grown in situ on such surface before pneumatic compacting commences. More specifically, the invention contemplates a sintering method comprising the principle steps of compacting a plurality of iron particles in a die to form an unsintered compact, heating the unsintered compact sufficiently to sinter the particles together into a sintered compact, oxidizing the iron particles at the surface of the compact to form a substantially gas impermeable oxide barrier at said surface, and pneumatically isostatically densifying the oxide-sealed sintered compact at an elevated temperature using a high pressure gaseous pressing medium. The oxide may be grown on the surface of the compact either before or after sintering, and substantially prevents penetration of the pressing gas into the bowels of the sintered compact during the densifying. Preferably, oxidation will occur before sintering when the compact is still hot from a delubing step. For most applications, the oxide layer need not be removed. In fact, retaining the oxide surface enhances the corrosion resistance of the sintered compact. The oxide will most preferably be magnetite (i.e., $Fe_3O_4$) formed by steaming the compact at temperatures below about 1058° F.

DETAILED DESCRIPTION OF THE INVENTION

Densified sintered metal compacts are made by the process described hereafter. Iron particles having particle sizes varying from about 100 microns to about 400 microns in diameter are blended with about ½% by weight to about 1¼% by weight of a suitable lubricant known to those skilled in the art (e.g., ethylene bisstearateamide sold by the Lonza company under the label ACRAWAX™), and uniaxially compacted in a steel die at pressures between about 20 tons per square inch (tsi) and 55 tsi to form an unsintered "green" compact having a density of about 6.9 g/cc (i.e., 12% porosity) to 7.35 g/cc (i.e., 5.7% porosity). The green compacts can also be made using conventional Cold Isostatic Pressing (CIP) techniques, wherein the compact is made by pressing at about 60,000 psi at room temperature to produce green compacts having a density varying between about 6.9 g/cc and 7.0 g/cc. This compaction may be performed at room temperature, but will preferably be performed at a temperature between about 300° F. and about 500° F. to achieve higher green densities. When higher temperature compaction is used the iron powder is preferably preheated to about 170° F.–375° F. and the die preheated to about 300° F.–550° F. Best isostatic pressing of the compacts is achieved when the green (i.e., unsintered) compacts have a substantially uniform density throughout and are crack-free at the surface. Nonuniform green density can result in lower than expected final density and deep surface cracks can result in poor oxide sealing of the surface. The term "iron" as used herein is intended to include not only pure iron, but also those alloys of iron that are used in the sintered powdered metal industry and include such alloyants as copper, nickel, zinc, tin, molybdenum and manganese, inter alia. It has also been found to be desirable to add a small amount (i.e., about 0.4%–0.8% by weight) phosphorous (i.e., as $Fe_3P$) to iron particles, to improve yield strength, ultimate tensile strength, magnetic flux density and maximum magnetic permeability,—albeit at some sacrifice to percent elongation at P levels greater than about 0.6% by weight.

The green compact is next heated in a suitable atmosphere to (1) delube the compact, and (2) sinter the iron particles together. Delubing typically involves heating the green compact to a temperature of about 800° F. to about 1400° F. and holding it there for about 15 minutes to about 30 minutes in a reducing atmosphere to burn off the lubricant. Some bonding of the particles begins during the delubing step. Thereafter, the delubed (i.e., unsintered) compact is heated up to a sintering temperature of about 2050° F. to about 2350° F. for about 15 minutes to about 60 minutes (preferably to about 2150° F. for about sixty minutes) to sinter the particles together. At ambient temperatures the compact will typically have an as-sintered density of about 6.9 g/cc to about 7.4 g/cc.

Many applications of sintered metal compacts require higher densities than are typically obtained from as-sintered compacts. For example, many properties such as toughness, tensile strength, compressive strength, Young's modulus, electromagnetic characteristics (e.g., flux density, permeability, and core losses), and Poission's ratio improve with increased density. In order to achieve higher densities (i.e., up to ca. 7.8 g/cc), the sintered compact is pneumatically isostatically compacted. In accordance with the present invention, an improved isostatic compacting method is provided for further densifying a sintered iron compact including the principle step of sealing the outside surface of the compact with a substantially gas impervious layer of iron oxide grown in situ on such surface before pneumatic isostatic compacting commences. In this regard, the iron particles at the surface of the compact are oxidized at elevated temperatures to form a substantially gas impermeable oxide barrier on the surface of, and in the pores at the surface of, the compact. The oxide barrier substantially prevents penetration of the gaseous isostatic pressing medium into the bowels of, or inner pores of, the sintered compact during the isostatic densifying step and will vary in thickness from about 0.0003 in. to about 0.0010 in. (average less than 0.0008 in.). The oxide also seals any cracks that might exist on the surface of the compact. In one embodiment, the oxide layer is grown on the surface of the sintered compact after sintering. Preferably however, the oxide layer is grown on the surface of the unsintered compact immediately following the delubing step. Most preferably, the compact will be subjected to steam to produce $Fe_3O_4$. In general, steaming to oxidize sintered iron compacts is a process well known to those skilled in the art for producing protective coatings having good wear resistance and corrosion resistance. The steaming conditions for producing such oxide coatings are also well known and applicable to form sealing coatings for purposes of the present invention. At temperatures below about 1058° F., $Fe_3O_4$ readily forms. At higher temperatures, which are desirable to shorten oxidizing time, FeO (i.e., WUSTITE) forms. When steaming at such higher temperatures, care must be taken to insure that the steamed compact does not cool below about 1058° F. before isostatic pressing. In this regard, below about 1058° F. the FeO becomes unstable and breaks down into breakdown products which are not as effective barriers to the pressing medium (e.g., gas) as the $Fe_3O_4$ or FeO.

Preparatory to steaming the compacts are placed in a heated treatment chamber (e.g., delubing furnace) from which all air has been removed (i.e., down to less than about 20 ppm air). This is preferably accomplished by simply flowing nitrogen or argon through the chamber for about two hours at a rate of about 300 CFH to about 500 CFH (depending on the size of the chamber). Steam is introduced into the chamber by passing nitrogen into a vessel full of water heated to about 180° F. The nitrogen-rich water is pumped to a manifold which services one or more nozzles which feed the treatment chamber. Water flow rate will be about 15 to about 100 SCFH depending on the size of the treatment chamber. As the water sprays out of the nozzles into the heated treatment chamber, it flashes to form steam which oxidizes the surface of the compact according to the following reactions (i.e., at temperatures less than about 1058° F.).

$$3Fe+4H_2O \rightarrow Fe_3O_4+4H_2$$

The steaming conditions will be the same regardless of whether the compact is steamed before or after sintering. Preferably, steaming will be carried out following delubing, at about the same temperature as delubing, and for a period of about five to about 30 minutes. Depending on the steaming temperature and the thickness of the oxide layer needed, steaming time can vary from about three minutes to about 60 minutes. High temperatures and shorter steaming times result in less penetration into the surface of the compact. Preferably, steaming will be accomplished on a continuous production basis in the same continuous flow through furnace (suitably modified with a steaming chamber) where delubing and sintering occurs.

Following steaming, the green, unsintered compact is sintered as described above, and is then ready for isostatic compressing. The heated compact is transferred to a pressure vessel, and therein subjected to a pressing gas (e.g., nitrogen or argon) pressure of from about 10,000 psi to about 60,000 psi for a period lasting anywhere from about 10 seconds to about 10 minutes. The sintered and pressed compact is then cooled at a controlled rate varying from about 90° F./min to about 900° F./min. Densities of up to about 7.8 g/cc have been obtained by this technique.

SPECIFIC EXAMPLE OF THE INVENTION

A rotor segment for an electric generator and weighing about 600 grams was made using iron particles purchased from the Hoeganaes Metals Co. under the Product No. 1000B. This material contained 0.45% by weight phosphorous and had a particle size of about 38 micrometers to about 212 micrometers. The powders contained about 0.6% by weight of a lubricant proprietary to Hoeganaes. The iron powder was preheated to about 300° F. and uniaxially compacted at 55 tsi in a steel die preheated to about 350° F. to yield a green compact having a density of 7.35 g/cc. The green compact was next "delubed" by heating for thirty (30) minutes at 1450° F. in an atmosphere comprising 75% by volume $H_2$ and 25% by volume $N_2$. The compact was then steamed for about thirty (30) minutes at about 1000° F. to form a $Fe_3O_4$ barrier layer on the surface having an average thickness between about 0.0003 and 0.0008 inches. The oxide increased the weight of the compact by about one percent (1%). In this particular example, the oxidized compact was allowed to cool to room temperature before sintering. In actual practice, such cooling would be eliminated and the hot compact would proceed directly to the sintering stage. The oxidized compact was then sintered for thirty (30) minutes at 2050° F. in an atmosphere comprising 75% $H_2$ and 25% $N_2$ to yield a sintered compact having a density of 7.4 g/cc. The as-sintered compact was then allowed to cool to room temperature before being subjected to a Pneumatic Isostatic Forging operation. In actual practice, such cooling would be eliminated and the hot sintered compact would proceed directly to the PIF chamber. The compact was placed in a pressure chamber, heated up to 2192° F. and subjected to an argon forging gas pressure of 45,000 psi for ten (10) seconds. The pressure in the chamber was ramped up at a rate of 1300 psi/sec. Finished density of the final compact was 7.8 g/cc.

While the invention has been described in terms of certain specific embodiments thereof, it is not intended to be limited thereto, but rather only to the extent set forth hereafter in the claims which follow.

What is claimed is:

1. In the method of forming a sintered product from a plurality of iron particles comprising the principle steps of compacting said particles in a die to form an unsintered compact having an external surface, heating said unsintered compact sufficiently to sinter said particles together and form a sintered compact, sealing said surface against penetration by gas, and pneumatically isostatically densifying said sintered compact at an elevated temperature using a high pressure gas, the improvement comprising:

oxidizing said iron particles at said surface of said compact prior to said densifying to form a substantially gas impermeable oxide barrier at said surface to substantially prevent penetration of said gas into said sintered compact during said densifying.

2. In the method of forming a sintered product from a plurality of iron particles comprising the principle steps of compacting said particles in a die to form an unsintered compact having an external surface, heating said unsintered compact sufficiently to sinter said particles together and form a sintered compact, sealing said surface against penetration by gas, and pneumatically isostatically densifying said sintered compact at an elevated temperature using a high pressure gas, the improvement comprising:

forming a sufficiently dense layer of $Fe_3O_4$ on said surface of said compact prior to said densifying to substantially prevent penetration of said gas into said sintered compact during said densifying.

3. In the method of forming a sintered product from a plurality of iron particles comprising the principle steps of compacting said particles in a die to form an unsintered compact having an external surface, heating said unsintered compact sufficiently to sinter said particles together and form a sintered compact, sealing said surface against penetration by gas, and pneumatically isostatically densifying said sintered compact at an elevated temperature using a high pressure gas, the improvement comprising:

subjecting said compact to steam prior to said densifying to so oxidize said iron particles at said surface of said unsintered compact as to form a sufficiently dense layer of iron oxide on said surface as to substantially prevent penetration of said gas into said sintered compact during said isostatic densifying.

4. The method according to claim 3 wherein said compact is subjected to said steam at a temperature below about 1050° F. to produce $Fe_3O_4$ on said surface.

5. The method according to claim 3 wherein said unsintered compact is subjected to said steam.

6. The method according to claim 3 wherein said sintered compact is subjected to said steam.

7. A method of densifying a sintered iron compact having a first density comprising the steps of sealing the outside surface of said compact with a substantially gas impervious layer of iron oxide, immersing said compact in a gas, and applying sufficient pressure to said gas to so compress said compact as to increase its density to a second density which is greater than said first density.

* * * * *